US005575205A

United States Patent [19]

Iida

[11] Patent Number: 5,575,205

[45] Date of Patent: Nov. 19, 1996

[54] STENCIL PRINTING MACHINE FOR REDUCING THE TIME REQUIRED FOR STENCIL MAKING AND STENCIL PRINTING

[75] Inventor: Kouichiro Iida, Tokyo, Japan

[73] Assignee: Riso Kagaku Corporation, Tokyo, Japan

[21] Appl. No.: 408,159

[22] Filed: Mar. 21, 1995

[30] Foreign Application Priority Data

Mar. 22, 1994 [JP] Japan ..... 6-050417

[51] Int. Cl.[6] ..... B41L 13/06

[52] U.S. Cl. ..... 101/116; 101/128.4

[58] Field of Search ..... 101/114, 116, 101/117, 118, 128.21, 128.4, 129, 127, DIG. 36

[56] References Cited

U.S. PATENT DOCUMENTS 5,165,338 11/1992 Okazaki et al. ..... 101/118

FOREIGN PATENT DOCUMENTS 62-28758 6/1987 Japan .
62-30117 6/1987 Japan .
279979 12/1987 Japan ..... 101/116
725127 1/1995 Japan .
2268446 1/1994 United Kingdom .

*Primary Examiner*—Stephen R. Funk
*Attorney, Agent, or Firm*—Sughrue, Mion, Zinn, Macpeak & Seas

[57] ABSTRACT

A stencil printing machine including a stencil presence/absence detector for determining whether or not a stencil sheet is wound on a rotary cylindrical drum when the rotary cylindrical drum is located at a predetermined position of rotation; a memory for storing latest data on the presence or absence of the stencil sheet which is detected by the stencil presence/absence detector and a controller which, in confirmation of the presence or absence of a stencil sheet for a printing process or a stencil making process, reads the latest data from the memory and performs necessary processes according to the latest data thus read.

8 Claims, 6 Drawing Sheets

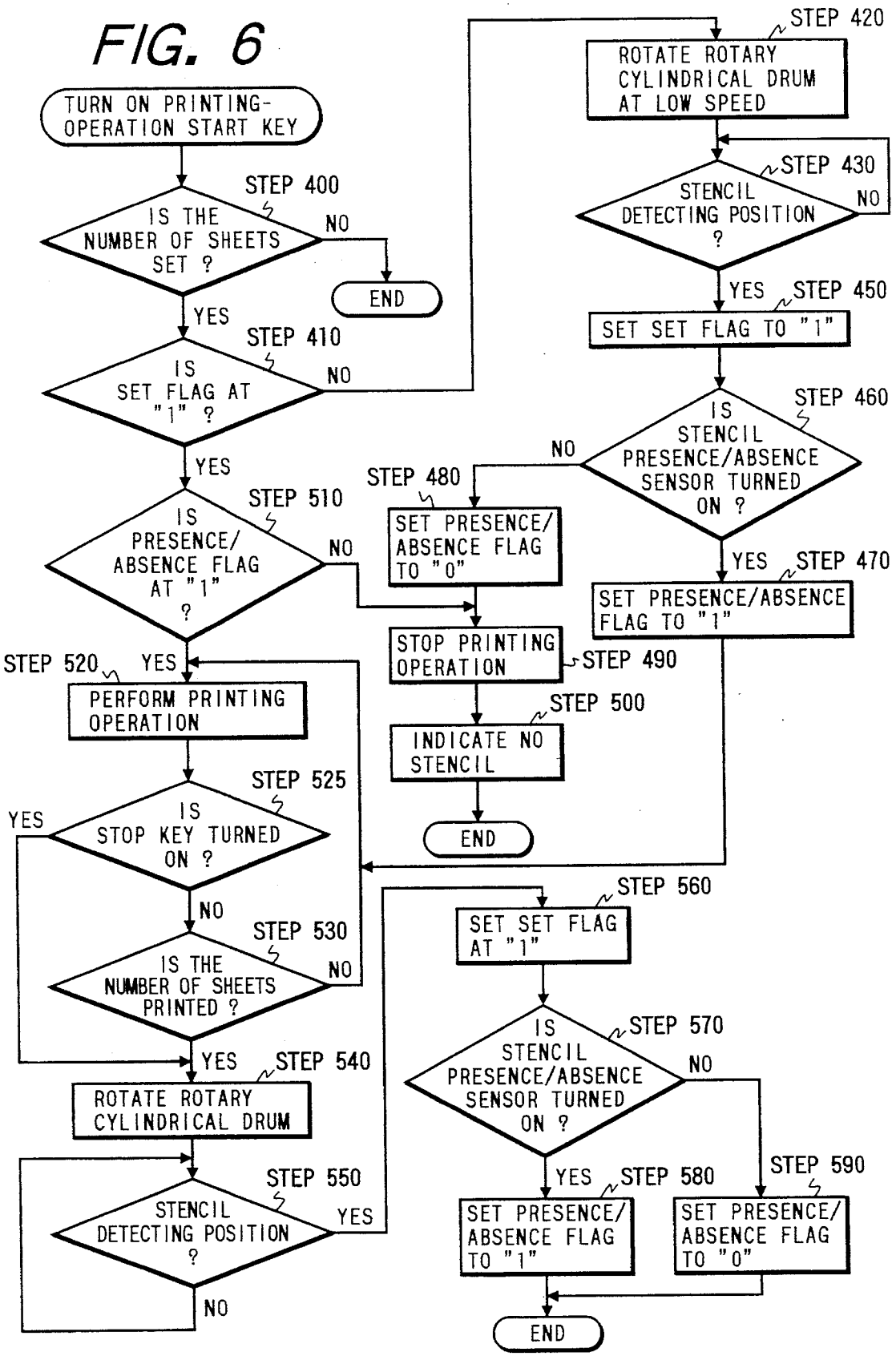
FIG. 6
TURN ON PRINTING-OPERATION START KEY
STEP 400
IS THE NUMBER OF SHEETS SET ?
NO
END
YES
STEP 410
IS SET FLAG AT "1" ?
NO
YES
STEP 510
IS PRESENCE/ ABSENCE FLAG AT "1" ?
NO
STEP 520
YES
PERFORM PRINTING OPERATION
STEP 525
IS STOP KEY TURNED ON ?
YES
NO
STEP 530
IS THE NUMBER OF SHEETS PRINTED ?
NO
YES
STEP 540
ROTATE ROTARY CYLINDRICAL DRUM
STEP 550
STENCIL DETECTING POSITION ?
YES
NO
STEP 420
ROTATE ROTARY CYLINDRICAL DRUM AT LOW SPEED
STEP 430
STENCIL DETECTING POSITION ?
NO
YES
STEP 450
SET SET FLAG TO "1"
STEP 460
IS STENCIL PRESENCE/ABSENCE SENSOR TURNED ON ?
NO
STEP 480
SET PRESENCE/ ABSENCE FLAG TO "0"
YES
STEP 470
SET PRESENCE/ABSENCE FLAG TO "1"
STOP PRINTING OPERATION
STEP 490
STEP 500
INDICATE NO STENCIL
END
STEP 560
SET SET FLAG AT "1"
STEP 570
IS STENCIL PRESENCE/ABSENCE SENSOR TURNED ON ?
NO
YES
STEP 580
SET PRESENCE/ ABSENCE FLAG TO "1"
STEP 590
SET PRESENCE/ ABSENCE FLAG TO "0"
END

STENCIL PRINTING MACHINE FOR REDUCING THE TIME REQUIRED FOR STENCIL MAKING AND STENCIL PRINTING

BACKGROUND OF THE INVENTION

1. Field of Invention

This invention relates to stencil printing machines, and more particularly to a stencil printing machine which performs necessary operations depending on whether or not a stencil sheet is wound on the rotary cylindrical drum.

2. Description of Related Art

A stencil printing machine is known in the art in which a stencil sheet is supplied to the rotary cylindrical drum set at a predetermined position at which a stencil sheet is to be wound (hereinafter referred to as "a home position", when applicable), and then it is wound on the drum by turning the drum. The machine has been disclosed, for instance, by Examined Japanese Patent Publication No. Sho. 62-30117.

With a stencil printing machine of this type, in order to wind a stencil sheet (hereinafter referred to as "a new stencil sheet", when applicable) on the rotary cylindrical drum, the following operations are carried out: First, it is determined whether or not another stencil sheet (hereinafter referred to as "an old stencil sheet", when applicable) has been wound on the drum. When the old stencil sheet is on the drum, a stencil discharging process is performed to remove the old stencil sheet from the drum. After the stencil discharging process, a stencil winding process is carried out to wind the new stencil sheet on the drum. On the other hand, in the case where it is determined that no stencil sheet is on the drum, the stencil winding process is started immediately.

After it is ensured that the new stencil sheet has been wound on the drum, a sheet supplying operation is started; that is, a stencil printing operation is started.

Conventionally, in order to determine whether or not a stencil sheet has been wound on the rotary cylindrical drum, a stencil presence/absence detection is carried out as follows: A sensor reaction piece of non-reflection type made of black sponge or the like is provided in the ink non-passage part of the tubular wall of the drum. The sensor reaction piece is located near a stencil clamp and is covered with a stencil sheet, while a reflection type sensor is fixedly mounted on the machine frame in such a manner as to confront the tubular wall of the drum, so that the quantity of light received by the sensor is changed depending on whether or not the sensor reaction piece is covered with a stencil sheet. That is, it is determined from the variations in the quantity of light received by the sensor whether or not a stencil sheet is wound on the drum. In this stencil presence/absence detection, it is necessary to turn the drum until the sensor reaction piece on the drum comes to a predetermined position where it confronts the sensor (hereinafter referred to as "a stencil presence/absence detecting position", when applicable).

If the stencil presence/absence detecting position is the position of rotation where a stencil winding operation should be started (hereinafter referred to as "a stencil-winding-operation starting rotational position", when applicable), then it is unnecessary to turn the drum thereby to determine whether or not the old stencil sheet is left on the drum. However, in this case, it cannot be detected immediately after the start of the stencil winding operation whether or not the new stencil sheet is correctly wound on the drum (being satisfactorily clamped).

Hence, it is necessary to provide two sensors, one sensor whose stencil presence/absence detecting position is the stencil-winding-operation starting rotational position, and the other sensor whose stencil presence/absence detecting position is the position which the drum takes being turned through a small angle, for instance 70° to 80°, from the stencil-winding-operation starting rotational position.

For a detailed description of a stencil presence/absence detecting operation using those two sensors, it is requested to refer to the specification and the drawings of Unexamined Japanese Patent Publication No. Hei. 7-25127.

On the other hand, in the case where only the sensor whose stencil presence/absence detecting position is the position which the drum takes after being turned through a small angle is employed, it is unnecessary to provide two sensors; however, before the new stencil sheet is wound on the drum, it is necessary to cause the drum to make one rotation thereby to determine whether or not the old stencil sheet is on the drum. Furthermore, in order to detect whether or not the used stencil sheet is left on the drum before the start of the printing operation, the drum must be turned one rotation. This increases the time required for the stencil winding operation and accordingly for the stencil printing operation; more specifically, the time which elapses from the time instant that the stencil-making-operation start key or the stencil-printing-operation start key is operated until the first stencil print is obtained.

SUMMARY OF THE INVENTION

In view of the foregoing, an object of the invention is to provide a stencil printing machine in which it is unnecessary to provide the two sensors to perform a stencil winding process and a stencil printing process as required, and in all conditions, it is positively determined whether or not a stencil sheet is on the rotary cylindrical drum. A loss of time due to the stencil presence/absence detection is minimized. And the period of time which elapses from the time instant that the stencil-making-operation start key or the stencil-printing-operation start key is operated until the first stencil print is obtained is shortened.

In order to achieve the object, a first aspect of the present invention provides a stencil printing machine which, according to the invention, comprises:

stencil presence/absence detecting means for determining whether or not a stencil sheet is wound on a rotary cylindrical drum when the drum is located at a predetermined position of rotation;

memory means for storing latest data on the presence or absence of the stencil sheet which is detected by the stencil presence/absence detecting means; and control means which, in confirmation of the presence or absence of the stencil sheet for a printing process or a stencil making process, reads the latest data (stencil presence/absence data) from the memory means and perform necessary processes according to the latest data thus read.

A second aspect of the invention provides a stencil printing machine having a rotary cylindrical drum removable from the stencil printing machine, the stencil printing machine comprising:

stencil presence/absence detecting means for determining whether or not a stencil sheet is wound on the rotary cylindrical drum when the rotary cylindrical drum is located at a predetermined position of rotation;

stencil presence/absence data storing means for storing latest data on the presence or absence of a stencil sheet which is detected by the stencil presence/absence detecting means;

drum removal detecting means for detecting the removal of the rotary cylindrical drum;

drum removal data storing means for storing latest data on the removal of the rotary cylindrical drum which is detected by the drum removal detecting means; and control means which, in confirmation of the presence or absence of a stencil sheet for a printing process or a stencil making process, reads drum removal data from the rotary cylindrical drum removal data storing means, and when the drum removal data indicates that the rotary cylindrical drum is not removed, reads stencil presence/absence data from the stencil presence/absence data storing means, and performs necessary processes according to the stencil presence/absence data thus read, and when the drum removal data indicates that the rotary cylindrical drum has been removed and reloaded, turns the rotary cylindrical drum, and causes the stencil presence/absence detecting means to detect whether or not a stencil sheet is wound on the rotary cylindrical drum, and performs necessary processes according to the result of detection by the presence/absence detecting means.

In the stencil printing machine of the first and second aspects, latest data on the presence or absence of a stencil sheet which is detected by the stencil presence/absence detecting means is stored in the memory means, and in confirmation of the presence or absence of a stencil sheet for a printing process or stencil making process, necessary processes are performed according to the latest data stored in the memory means. Hence, it is unnecessary to turn the drum to the stencil presence/absence detecting position to detect whether or not a stencil sheet is on the drum.

In the stencil printing machine of the second aspect, immediately after the power switch is turned on; or in the stencil printing machine in which the rotary cylindrical drum can be removed from the machine, when the drum is removed out of the machine; for more positive operation, the stencil presence/absence data stored in the memory means is not referred to, and in those cases the stencil presence/absence detecting means is operated to determine whether or not a stencil sheet is wound on the drum.

BRIEF DESCRIPTION OF THE DRAWINGS

FIG. 6 is a flow chart showing a printing process routine in the stencil printing machine according to the invention.

DETAILED DESCRIPTION OF THE PREFERRED EMBODIMENTS

One preferred embodiment of the invention will be described with reference to the accompanying drawings in detail.

Figure 1:
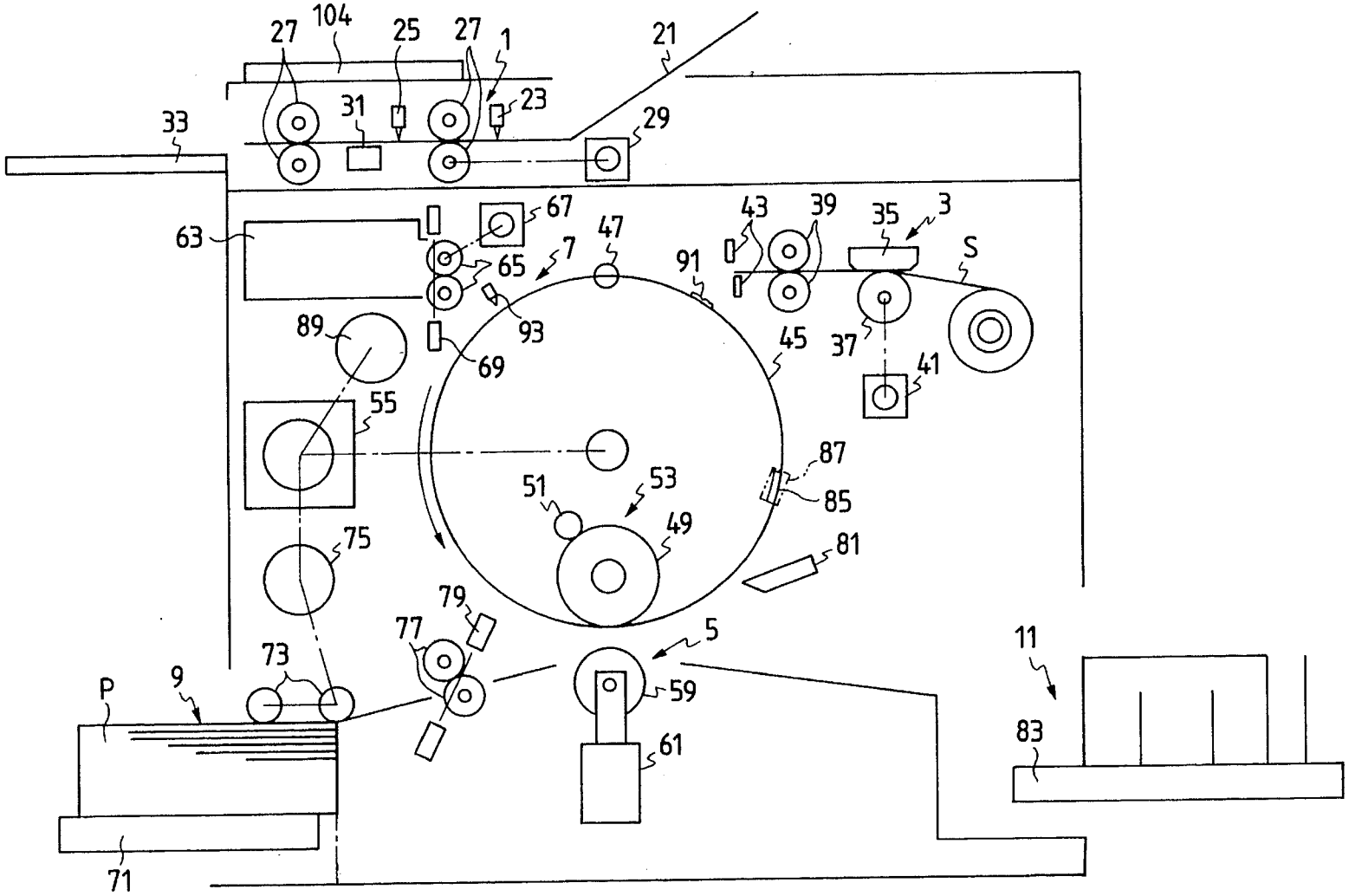
FIG. 1 is an arrangement of a stencil printing machine according to the invention.

FIG. 1 shows a stencil printing machine according to the invention. In other words, what is shown in FIG. 1 is a full-automatic stencil printing machine having a stencil making function. The stencil printing machine comprises: a photo-electric original image reading section 1; a heat-sensitive stencil making section 3; a stencil printing mechanism section 5; a stencil discharging section 7; a sheet supplying section 9; and a sheet discharging section 11.

The original image reading section 1 comprises: an original setting stand 21 on which an original to be printed out is placed; reflection type original sensors 23 and 25 for detecting the presence or absence of an original in the original image reading section 1; pair of original conveying rollers 27; a stepping motor 39 for driving the original conveying rollers 27; a contact type image sensor 31 of contact type which optically reads the image of a given original to output an electrical signal; and an original discharging tray 33.

The stencil making section 3 comprises: a thermal head 35 which has a plurality of heat generating elements arranged in a direction perpendicular to the surface of the drawing to make a stencil by thermally processing a stencil sheet S; a platen roller 37; a pair of stencil sheet conveying rollers 39; a stepping motor 41 for driving the platen roller 37 and the stencil sheet conveying rollers 39; and a stencil cutter 43.

The stencil printing mechanism section 5 comprises: a rotary cylindrical drum 45 which is so designed that it is rotatable around its central axis and allows printing ink to pass through it; a stencil clamp 47 provided in the part of the tubular wall of the drum 45 through which no ink can pass (hereinafter referred to as "an ink non-passage part", when applicable); an ink supplying mechanism section 53 provided inside the drum 45, the section 53 having a squeegee roller 49 and a doctor roller 51; a main motor 55 for rotating the drum 45 counterclockwise in FIG. 1; a press roller 59; and a solenoid device 61 for driving the press roller 59.

The stencil discharging section 7 includes: a stencil discharging box 63; a pair of used stencil conveying rollers 65 which separate a used stencil sheet S from the drum 45 and convey it towards the stencil discharging box 63; a DC motor 67 for driving the rollers 65; and a stencil discharging sensor of transmission type 69 which detects whether or not a stencil sheet S is present at the rollers 65.

The sheet supplying section 9 comprises: a sheet supplying stand 71 on which printing sheets P are stacked, the stand 71 being moved vertically by a vertically moving means (not shown); pick-up rollers 73 for taking printing sheets P out of the sheet supplying stand 71 one by one; a sheet supplying clutch 75 for intermittently transmitting the rotation of the main motor 55 to the pickup rollers 73; a pair of sheet conveying rollers 77 for supplying a printing sheet P to the space between the drum 45 and the press roller 59 with predetermined timing; and a sheet sensor of transmission type 79 for detecting whether or not a printing sheet P is present at the rollers 77.

The sheet discharging section 11 comprises: a sheet separating claw 81 for separating a printed sheet p from the rotary cylindrical drum 45, and a sheet discharging stand 83 on which printed sheets P are stacked.

A magnet piece 85 is mounted on the drum 45 at the end, and a stencil-winding-operation starting rotational position sensor 87 is fixedly provided on the machine body side. The sensor 87 is made up of a magnetic sensor which responds to the magnet piece 85 when the drum 45 is turned until the stencil clamp 47 is located at the top as shown in FIG. 1; that is, when the drum 45 takes a stencil-winding-operation starting rotational position. The aforementioned main motor 55 is connected to a rotary encoder 89, which is reset by the output signal of the rotational position sensor 87, to quantitatively detect the position of rotation of the drum 45.

A non-reflection type sensor reaction piece 91 made of black sponge is fixedly mounted on the ink non-passage part of the tubular wall of the drum 45 near the stencil clamp 47. More specifically, the sensor reaction piece 91 is shifted about 30° in angular position from the stencil clamp 47 as viewed in the direction of rotation of the drum 45 (in the counterclockwise direction in FIG. 1).

A stencil presence/absence sensor of reflection type 93 is fixedly provided on the machine frame in such a manner that it is located within an angle of rotation of from the stencil-winding-operating starting rotational position to a sheet-supplying-operation starting rotational position and it is confronted with the above-described sensor reaction piece. In the embodiment, the position where the sensor reaction piece 91 confronts with the stencil presence/absence sensor 3, namely, a stencil presence/absence detecting position is the position which the drum 45 takes when turned through 75° from the stencil-winding-operation starting rotational position.

In the stencil presence/absence sensor 93, the quantity of light received thereby changes depending on whether or not the sensor reaction piece 91 is covered with a stencil sheet S when the drum 45 is turned so that the sensor 93 confronts with the sensor reaction piece 91. Hence, the stencil presence/absence sensor 93 detects from the variations in the quantity of light whether or not a stencil sheet S has been wound on the rotary cylindrical drum 45.

The rotary cylindrical drum 45 has a conventional loading structure so that it can be freely loaded into or unloaded from the machine frame, for example when it is replaced with another one. The drum loading and unloading section has a 15. drum set switch 95 (see FIG. 2) to detect whether or not the drum 45 is set at a predetermined printing position.

This drum loading and unloading structure is described in the specification of Examined Japanese Patent Publication No. Sho. 62-28758 in detail.

Figure 2:
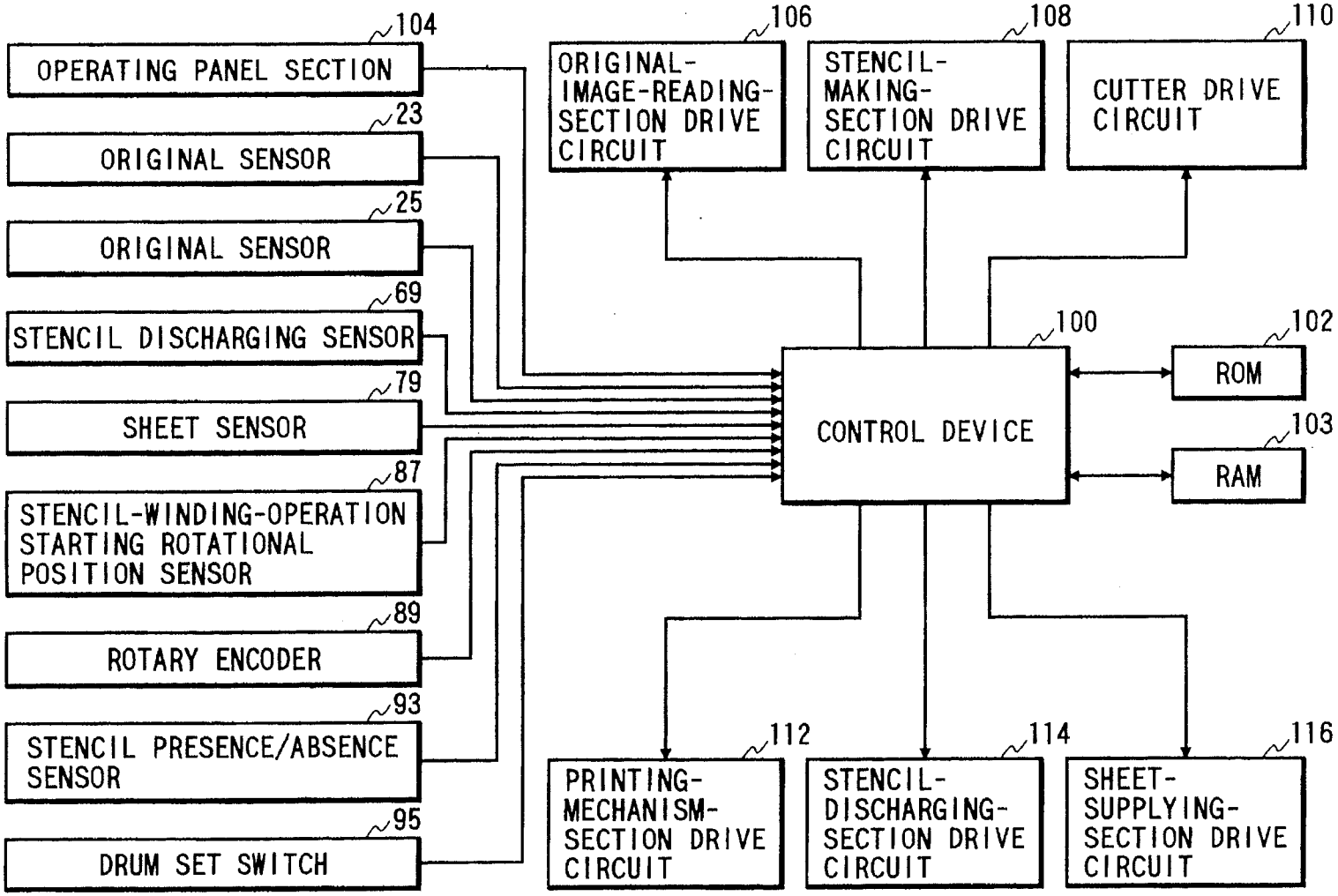
FIG. 2 is a block diagram showing the arrangement of a control system in the stencil printing machine of the invention.

FIG. 2 shows a control system for the stencil printing machine designed as described above. The control system has a microcomputer-operated control device 100 including a CPU for controlling the operation of the whole machine. The control device 100 receives a variety of data from a ROM 102 adapted to store a system program, a RAM 103 as a working memory to store a variety of data in a rewriting mode, and an operating panel section 104 including a stencil-making-operation start key, a printing start key, a ten-key board for inputting the number of printed sheets, and a display unit for displaying, for instance, errors; and further receives detection signals from the original sensors 23 and 25, the stencil discharging sensor 69, the sheet sensor 79, the stencil-winding-operation starting rotational position sensor 87, the rotary encoder 89, the stencil presence/absence sensor 93, and the drum set switch 95. The control device 100 applies, according to the system program, drive instruction signals to an original-image-reading-section drive circuit 106 adapted to drive the original image reading section 1, a stencil-making-section drive circuit 108 adapted to drive the stencil making section 3, a cutter drive circuit 110 adapted to drive the stencil cutter 43, a stencil-printing-mechanism-section drive circuit 112 adapted to drive the stencil printing mechanism section 5, a stencil-discharging-section drive circuit 114 adapted to drive the stencil discharging section 7, and a sheet-supplying-section drive circuit 116 adapted to drive the sheet supplying section 9.

The control device 100 performs a process of writing in the RAM 103 latest data on the presence or absence of a stencil detected by the stencil presence/absence sensor 93, and a process of writing in the RAM 103 latest data as to whether or not the drum set switch 95 is turned off once by the removal of the drum 45. Furthermore, when, in a printing process or in a stencil making process, it is detected whether or not a stencil sheet is on the drum 45, the control device 100 reads drum removal data from the RAM 103. In the case where the drum removal data thus read indicates that the drum is not unloaded, and it has not immediately after the power switch is turned on, the control device 100 reads stencil presence/absence data from the RAM 103. The control device 100 performs necessary processes according to the result of the detection. In the case where the drum removal data indicates that the drum has been unloaded, or it is immediately after the power switch is turned on, the control device 100 operates to rotate the drum 45 that has been reloaded and to cause the stencil presence/absence sensor 93 to detect whether or not a stencil sheet S is on the drum 45, and performs necessary processes according to the result of the detection.

The operation of the stencil printing machine designed as designed above will be described with reference to flow charts shown in FIGS. 3 through 6. In those flow charts, a set flag and a presence/absence flag are used which are defined as follows:

The set flag is set to "0" when the drum set switch 95 is turned off, or when the power switch is turned off; in other words, it is set to "0" immediately after the power switch is turned on. When the stencil presence/absence sensor 93 performs a stencil presence/absence detection, the set flag is set to "1". The set flag is written, as drum removal data and power on/off data, in the RAM 103.

The presence/absence flag is stencil presence/absence data. In the case where the result of the stencil presence/absence detection performed by the stencil presence/absence sensor 93 indicates the presence of a stencil sheet (or when the sensor is turned on), the presence/absence flag is set to "1". On the other hand, in the case of the absence of a stencil sheet (or when the sensor is turned off), the presence/absence flag is set to "0". Those flags are written in the RAM 103.

Figure 3:
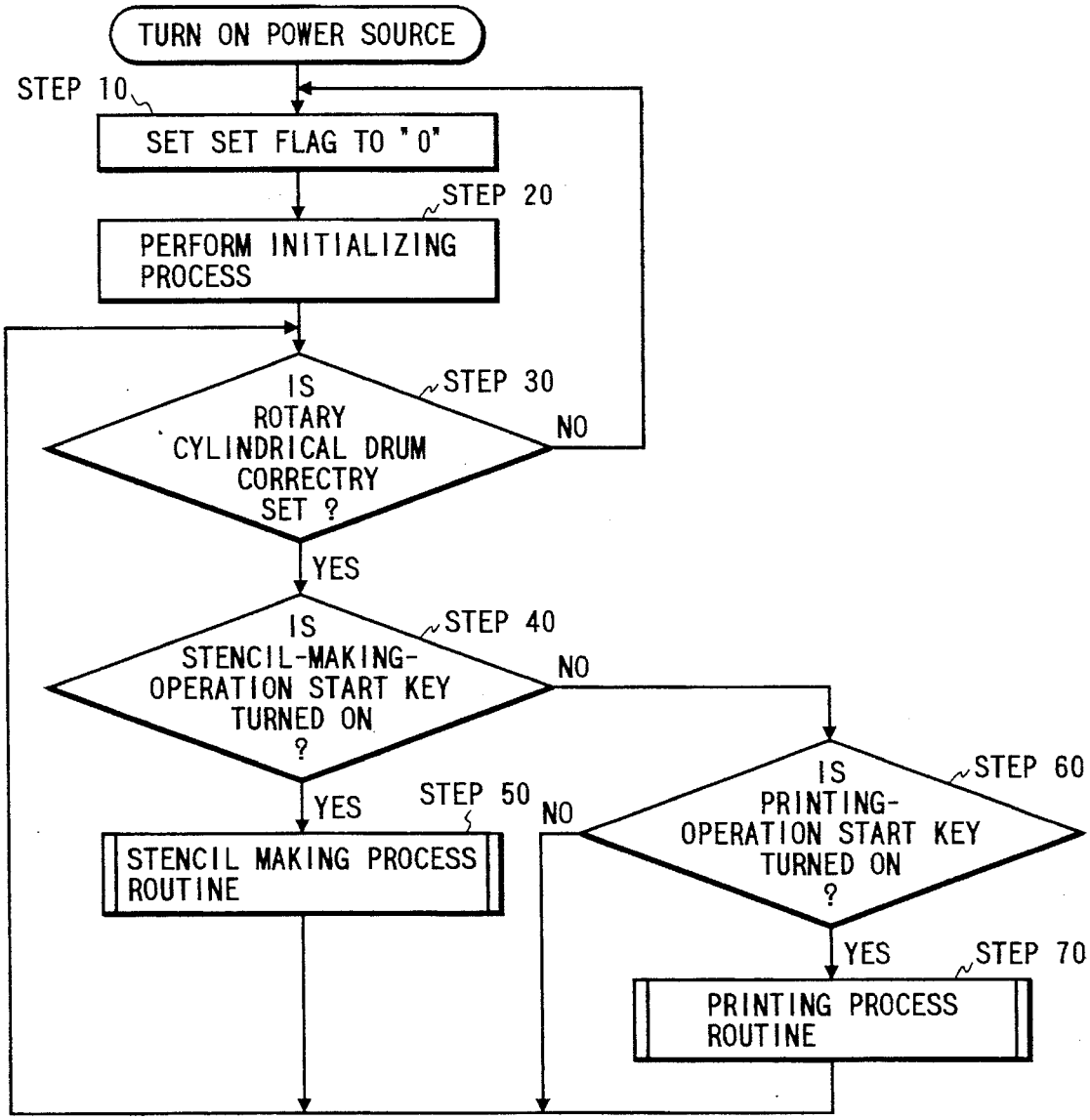
FIG. 3 is a flow chart for a description of the general operation of the stencil printing machine according to the invention.

FIG. 3 shows a general operation flow. This operation flow starts when the power switch is turned on. First, the set flag is set to "0" (Step 10), and an initializing process is performed as required—for instance, the drum 45 is set at the stencil-winding-operation starting rotational position (Step 20).

Next, it is determined in Step 30 from the "on/off" state of the drum set switch 95 whether or not the drum 45 has been correctly set at the printing position. When it is determined that the drum 45 is not at the printing position; that is, when the drum set switch 95 is in "off" state, Step 10 is effected again so that the set flag is maintained at "0", or set to "0".

When it is determined that the drum 45 is correctly set at the printing position; that is, when the drum set switch 95 is in "on" state, then it is detected whether or not the stencil-making-operation start key or the printingoperation start key in the operating panel section 104 is turned on (Steps 40 and 60).

When none of those keys are turned on, Step 30 is effected again to determine whether or not the drum 45 is set at the printing position.

When the stencil-making-operation start key is turned on, a stencil making process routine is implemented (Step 50).

When the printing-operation start key is turned on, a printing process routine is implemented (Step 70).

Figure 4:
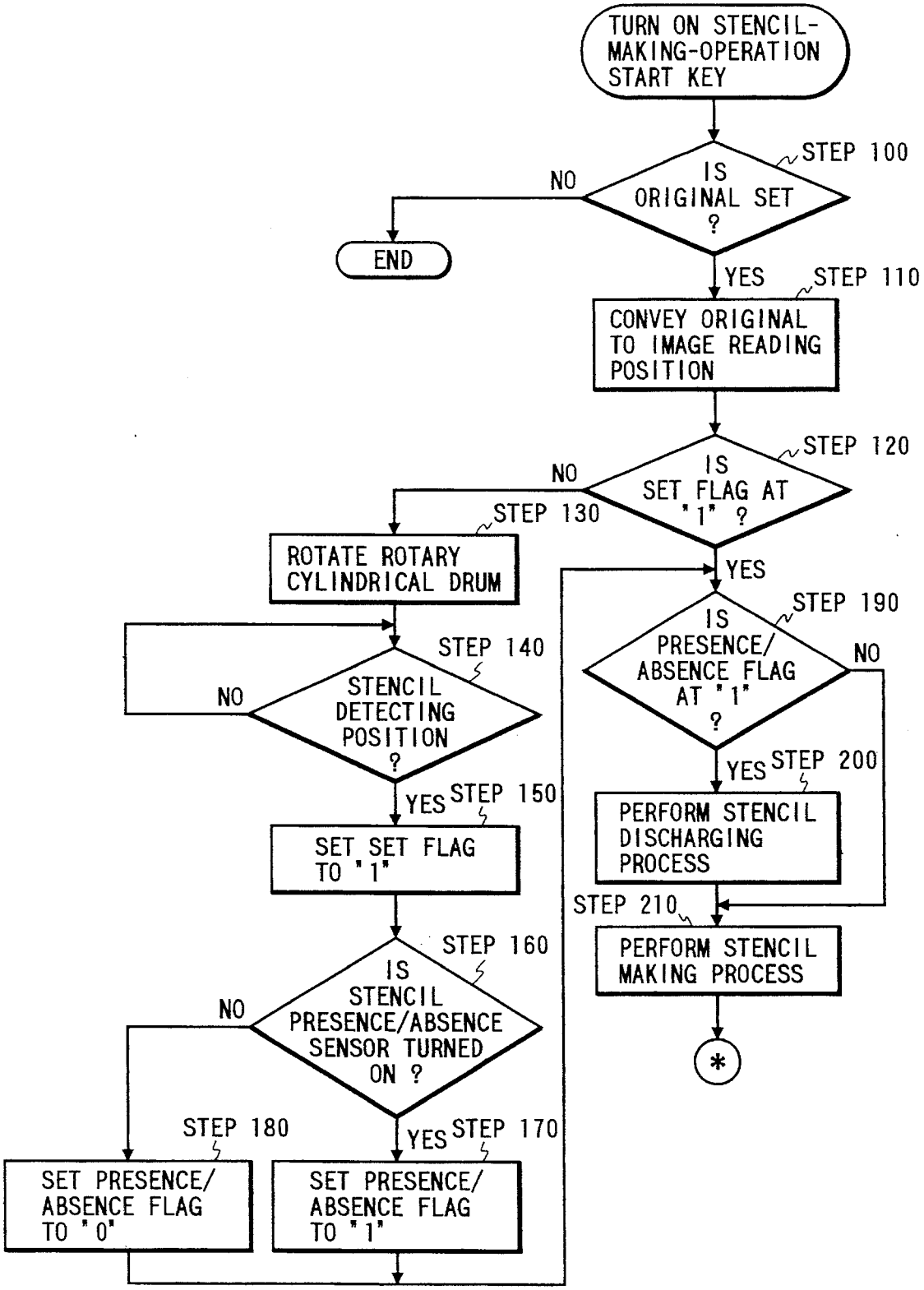
FIG. 4 is a flow chart showing the first half of a stencil making process routine in the stencil printing machine according to the invention.
Figure 5:
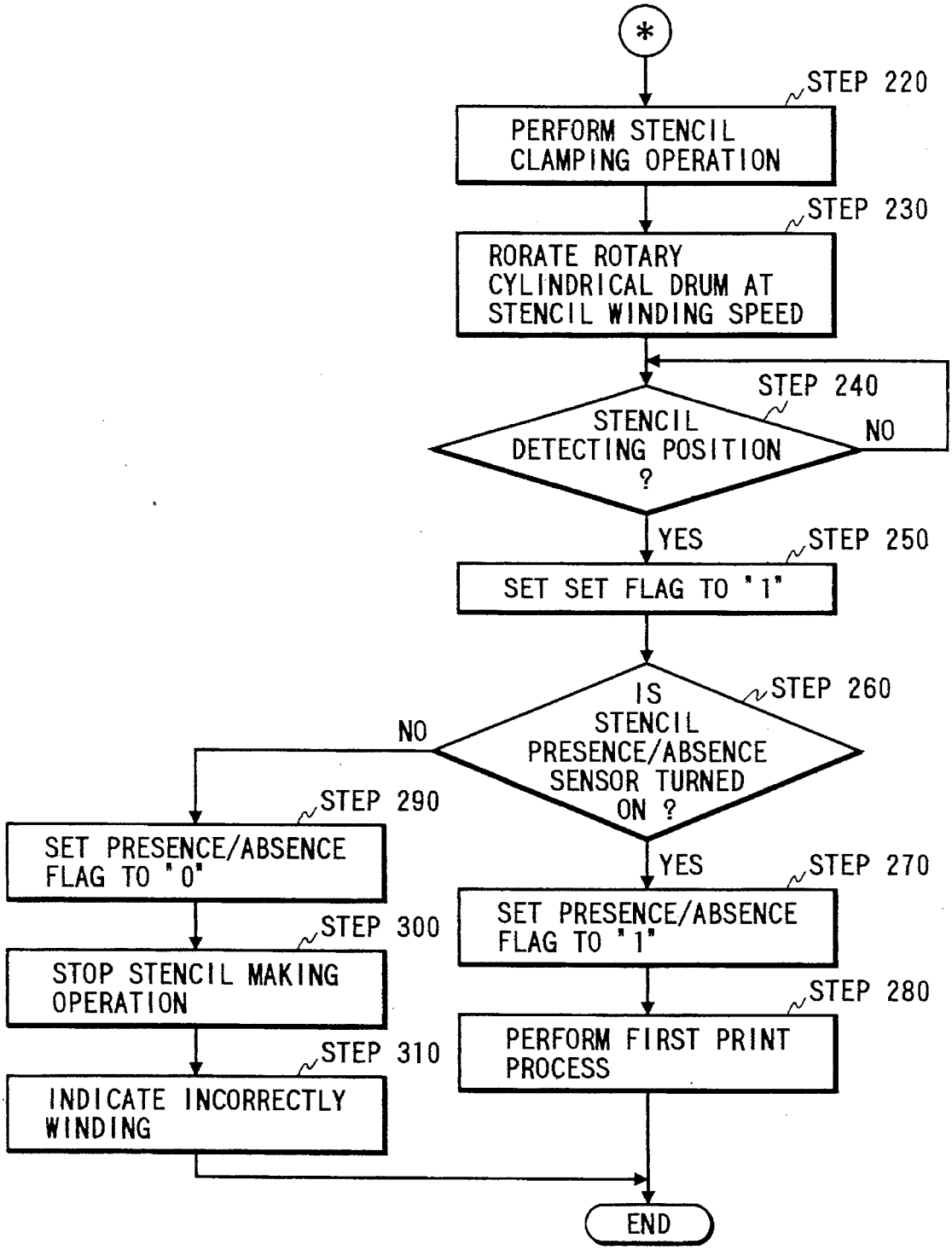
FIG. 5 is a flow chart showing the second half of the stencil making process routine in the stencil printing machine according to the invention.

FIGS. 4 and 5 shows the stencil making process routine. In this routine, first it is determined from the output signal of the original sensor 23 whether or not an original is set on the original setting stand 21 (Step 100). When it is determined that no original is set on the stand 21, the stencil making process routine is ended. When it is determined that an original is set on the original setting stand 21, the pair of original conveying rollers 27 are driven to convey the original to the position where it is read by the image sensor 31 (Step 110).

Next, it is determined whether or not the set flag is at "1" (Step 120). The set flag is at "0" immediately after the power switch is turned on, or when the drum 45 has been unloaded. In this case, the drum 45 is caused to make one rotation at low speed. During this rotation, the drum 45 comes to the stencil presence/absence detecting position (YES in Step 140). Then the set flag is set to "1" (Step 150), and it is determined whether or not the stencil presence/absence sensor 93 is turned on (Step 160). When it is determined that the sensor 93 is turned on; that is, in the case where the stencil sheet is present, the presence/absence flag is set to "1" (Step 170). When it is determined that the sensor 93 is in "off" state, then the presence/absence flag is set to "0" (Step 180). Thereafter, Step 190 is effected.

The arrival of the drum 45 at the stencil presence/absence detecting position is detected by the rotary encoder 89.

On the other hand, in the case where the set flag is at "1" in step 120; in other words, in the case where the presence/absence flag has been set at least once after the power switch is turned on, or after the drum is unloaded, a stencil presence/absence detecting operation of Steps 130 through 180 is omitted, and Step 190 is effected. This shortens the period of time required for the stencil making process.

In Step 190, it is determined whether or not the presence/absence flag is at "1". When it is determined that the presence/absence flag is at "1", a stencil discharging process is performed to remove the stencil sheet S from the drum 45 (Step 200). If the presence/absence flag is not "1", then it is unnecessary to perform the stencil discharging process, and therefore Step 210 is effected. In Step 210, the stencil making process is performed with the thermal head 35.

Next, a stencil clamping operation is carried out (Step 220). That is, the front edge of the stencil sheet S which is supplied from the stencil making section 3 towards the drum 45 is locked to the drum 45 with the stencil clamp 47.

After the stencil clamping operation, the drum 45 is turned at a predetermined stencil winding speed (Step 230). When the drum 45 is turned to the stencil presence/absence detecting position (Step 240), the set flag is set to "1" (Step 250). Then it is determined whether or not the stencil presence/absence sensor 93 is turned on (Step 260). When the sensor 93 is in "on" state, then it is determined that the stencil sheet S has been correctly wound on the drum, and the presence/absence flat is set to "1" (Step 270), and the first printing process is performed—for instance a printing sheet is supplied (Step 280).

When, on the other hand, the stencil presence/absence sensor 93 is in "off" state in Step 260, the presence/absence flag is set to "0" (Step 290), and it is determined that the new stencil sheet is not correctly wound on the drum, and the stencil making operation is stopped without delay (Step 300), while display is made to indicate that the stencil sheet is not correctly wound on the drum 45 (Step 310).

FIG. 6 shows the printing process routine. In this routine, first it is determined whether or not the number of sheets to be printed has been set, and if not, the printing process routine is ended. When it is determined that the number of sheets to be printed has been set (Step 400), then it is determined whether or not the set flag is at "1" (Step 410). When the set flag is at "0", the drum 45 is caused to make one rotation at low speed for detection of the presence or absence of a stencil sheet (Step 420). When the drum 45 is turned to the stencil presence/absence detecting position (YES in Step 430), the set flag is set to "1" (Step 450), and it is determined whether or not the stencil presence/absence sensor 93 is turned on (Step 460). When it is determined that the sensor 93 is in "on" state; that is, in the case where the stencil sheet is present on the drum 45, the presence/absence flag is set to "1" (Step 470), and thereafter Step 520 is effected.

On the other hand, when it is determined that the sensor 93 is in "off" state in Step 460; that is, in the case where no stencil sheet is present on the drum 45, the presence/absence flag is set to "0" (Step 480), and the printing operation is stopped (Step 490), and display is made to indicate that no stencil sheet is on the drum 45 (Step 500).

In the case where, in Step 410, it is determined that the set flag is at "1"; in other words, in the case where the presence/absence flag has been set at least once after the power switch is turned on or after the drum is unloaded, the stencil presence/absence detecting operation of Steps 420 through 480 is omitted, and Step 510 is effected. This will shorten the period of time which elapses until the printing operation is started.

In Step 510, it is determined whether or not the presence/absence flag is at "1". The fact that the presence/absence flag is not "1" means that no stencil sheet S is wound on the drum 45, and therefore Step 490 is effected. In Step 490, the printing operation is stopped, and, in Step 500, display is made to indicate that no stencil sheet is present on the drum 45.

When the presence/absence flag is at "1" in Step 510, the printing operation is started (Step 520). When the stop key on the operating panel 104 is turned on (YES in Step 525), or the number of printed sheets reaches the preset number of sheets to be printed (YES in Step 530), the drum 45 is caused to make one rotation at low speed (Step 540). When the drum 45 reaches the stencil presence/absence detecting position during the rotation (YES in Step 550), the set flag is set to "1" (Step 560), and it is determined whether or not the stencil presence/absence sensor 93 is turned on (Step 570). When it is determined that the sensor 93 is in "on" state, the presence/absence flag is set to "1" (Step 580). On the other hand, when the sensor 93 is in "off" state, then the presence/absence flat is set to "0" (Step 590).

As is apparent from the above description, in the stencil printing machine of the invention, latest data on the presence or absence of a stencil sheet which is detected by the stencil presence/absence detecting means such as the stencil presence/absence sensor is stored in the memory means by using the flag. And in confirmation of the presence or absence of a stencil sheet for the printing process or stencil making process, necessary processes are performed according to the latest data stored in the memory means. Hence, it is unnecessary to turn the drum to the stencil presence/absence detection position to detect whether or not a stencil sheet is on the drum. This feature minimizes the loss of time due to the stencil presence/absence detection, and reduces the period of time which elapses until the first print is obtained.

Furthermore, immediately after the power switch is turned on, or when, in the stencil printing machine whose rotary cylindrical drum can be removed therefrom, the drum is removed out of the machine, the stencil presence/absence data stored in the memory means is not referred to, and in those cases the stencil presence/absence detecting means is operated to determine whether or not a stencil sheet is wound on the drum. Hence, even if the stencil sheet is removed from the drum by hand when the machine is not in operation or when the drum is removed from the machine, no trouble will occur with the machine.

What is claimed is:

1. A stencil printing machine comprising:

stencil presence/absence detecting means for determining whether or not a stencil sheet is wound on a rotary cylindrical drum when said rotary cylindrical drum is located at a predetermined position of rotation;

memory means for storing latest data indicating the presence or absence of said stencil sheet which is detected by said stencil presence/absence detecting means; and control means for reading said latest data from said memory means and performing a printing process or a stencil making process according to whether said latest data indicates the presence of a stencil sheet.

2. The stencil printing machine according to claim 1, wherein said stencil printing machine further comprises: a stencil-making-operation start key connected to said control means, and a printing-operation start key connected to said control means, and wherein said control means further includes:

means for starting the stencil discharging process before the stencil making process when said stencil-making-operation start key is turned on and when said latest data indicates the presence of the stencil sheet;

means for starting the stencil making process when said stencil-making-operation start key is turned on and when said latest data indicates the absence of the stencil sheet;

means for starting the printing process when said printing-operation start key is turned on and when said latest data indicates the presence of the stencil sheet; and means for inhibiting the printing process when said printing-operation start key is turned on and when said latest data indicates the absence of the stencil sheet.

3. A stencil printing machine comprising:

stencil presence/absence detecting means for determining whether or not a stencil sheet is wound on a rotary cylindrical drum when said rotary cylindrical drum is located at a predetermined position of rotation;

stencil presence/absence data storing means for storing latest data indicating the presence or absence of a stencil sheet which is detected by said stencil presence/absence detecting means; and control means for, turning said rotary cylindrical drum, and causing said stencil presence/absence detecting means to detect whether or not said stencil sheet is wound on said rotary cylindrical drum immediately after a power switch is turned on or when the rotary cylindrical drum has been reloaded to a predetermined printing position, and at all times other than immediately after a power switch is turned on or when the rotary cylindrical drum has been reloaded to a predetermined printing position, reading said latest data from said data storing means and performing a printing process or a stencil making process according to whether said latest data indicates the presence of a stencil sheet.

4. The stencil printing machine according to claim 3, wherein said stencil printing machine further comprises: a stencil-making-operation start key connected to said control means, and a printing-operation start key connected to said control means, and wherein said control means further includes:

means for starting the stencil discharging process before the stencil making process when said stencil-making-operation start key is turned on and when said latest data indicates the presence of the stencil sheet;

means for starting the stencil making process when said stencil-making-operation start key is turned on and when said latest data indicates the absence of the stencil sheet;

means for starting the printing process when said printing-operation start key is turned on and when said latest data indicates the presence of the stencil sheet; and means for inhibiting the printing process when said printing-operation start key is turned on and when said latest data indicates the absence of the stencil sheet.

5. A stencil printing machine having a rotary cylindrical drum removable from said stencil printing machine, said stencil printing machine comprising:

stencil presence/absence detecting means for determining whether or not a stencil sheet is wound on said rotary cylindrical drum when said rotary cylindrical drum located at a predetermined position of rotation;

stencil presence/absence data storing means for storing latest data indicating the presence or absence of a stencil sheet which is detected by said stencil presence/absence detecting means;

drum removal detecting means for detecting the removal of said rotary cylindrical drum;

drum removal data storing means for storing latest data indicating whether said rotary cylindrical drum has been removed as detected by said drum removal detecting means; and control means for:

reading drum removal data from said drum removal data storing means upon confirmation of the presence or absence of a stencil sheet for a printing process or a stencil making process;

reading stencil present/absence data from said stencil presence/absence data storing means and performing a printing process or a stencil making process according to whether said latest data indicates the presence of a stencil sheet when said drum removal data indicates that said rotary cylindrical drum is not removed and;

turning said rotary cylindrical drum and causing said stencil presence/absence detecting means to detect whether or not a stencil sheet is wound on said rotary cylindrical drum when said drum removal data indicates that said rotary cylindrical drum has been removed and reloaded to a predetermined printing position.

6. The stencil printing machine according to claim 5, wherein said stencil printing machine further comprises: a stencil-making-operation start key connected to said control means, and a printing-operation start key connected to said control means, and wherein said control means further includes:

means for starting the stencil discharging process before the stencil making process when said stencil-making-operation start key is turned on and when said latest data indicates the presence of the stencil sheet;

means for starting the stencil making process when said stencil-making-operation start key is turned on and when said latest data indicates the absence of the stencil sheet;

means for starting the printing process when said printing-operation start key is turned on and when said latest data indicates the presence of the stencil sheet; and means for inhibiting the printing process when said printing-operation start key is turned on and when said latest data indicates the absence of the stencil sheet.

7. A method of making a stencil sheet for a stencil printing machine having a rotary cylindrical drum and a power switch for turning on and off said stencil printing machine, said method comprising the steps of:

determining whether a stencil sheet is wound on said rotary cylindrical drum;

rotating said drum to a stencil detecting position; and performing a stencil making process, wherein said rotating steps and said determining steps are only performed if said determining step is not performed at least once after said power switch has been turned on or at least once after said rotary cylindrical drum has been reloaded onto said stencil printing machine.

8. A method of printing with a stencil sheet for a stencil printing machine having a rotary cylindrical drum and a power switch for turning on and off said stencil printing machine, said method comprising the steps of:

determining whether a stencil sheet is wound on said rotary cylindrical drum;

rotating said drum to a stencil detecting position; and performing a stencil printing process, wherein said rotating steps and said determining steps are only performed if said determining step is not performed at least once after said power switch has been turned on or at least once after said rotary cylindrical drum has been reloaded onto said stencil printing machine.

* * * * *